US008226821B2

(12) United States Patent
MacArthur et al.

(10) Patent No.: US 8,226,821 B2
(45) Date of Patent: Jul. 24, 2012

(54) DIRECT COAL LIQUEFACTION WITH INTEGRATED PRODUCT HYDROTREATING AND CATALYST CASCADING

(76) Inventors: James B MacArthur, Denville, NJ (US); John E Duddy, Langhorne, PA (US)

( * ) Notice: Subject to any disclaimer, the term of this patent is extended or adjusted under 35 U.S.C. 154(b) by 266 days.

(21) Appl. No.: 12/583,276

(22) Filed: Aug. 19, 2009

(65) Prior Publication Data

US 2011/0042272 A1 Feb. 24, 2011

(51) Int. Cl.
*C10G 1/08* (2006.01)
*C10G 1/06* (2006.01)

(52) U.S. Cl. ..... 208/422; 208/8 LE; 208/10; 208/408; 208/412; 208/413; 208/415; 208/418; 208/419; 208/421; 208/423; 585/241

(58) Field of Classification Search ..... 208/8 LE, 208/10, 408, 412, 413, 415, 418, 419, 421, 208/422, 423; 585/241
See application file for complete search history.

(56) References Cited

U.S. PATENT DOCUMENTS 4,816,141 A * 3/1989 McLean et al. ..... 208/413
6,190,542 B1 * 2/2001 Comolli et al. ..... 208/423

* cited by examiner

*Primary Examiner* — Prem C Singh

(57) ABSTRACT

A multi-stage catalytic process for the direct liquefaction of coal is utilized with a hydrotreater to first liquefy and subsequently treat the product in one integrated process. A fresh hydrogenation catalyst is used to reduce heteroatoms (S, N) from coal liquids in the downstream hydrotreater. This catalyst is then cascaded and re-used in the direct coal liquefaction process, first in the low temperature Stage 1, and then re-used in the high temperature Stage 2. Coal liquid products have very low contaminants and can be readily used to produce gasoline and diesel fuel. Catalyst requirements are substantially lowered utilizing this novel process.

7 Claims, 1 Drawing Sheet

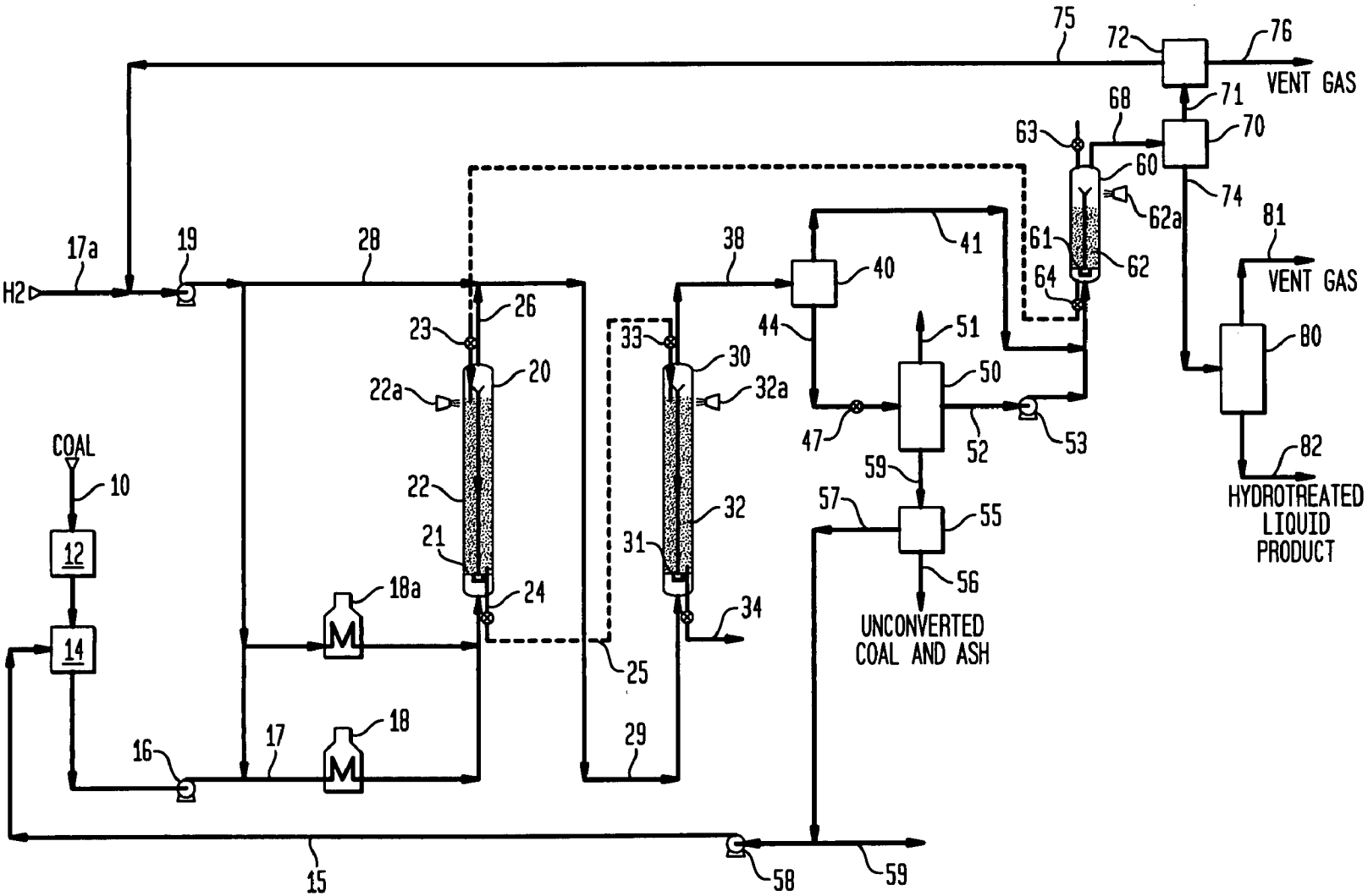
VENT GAS
VENT GAS
HYDROTREATED LIQUID PRODUCT
UNCONVERTED COAL AND ASH
COAL
H2

DIRECT COAL LIQUEFACTION WITH INTEGRATED PRODUCT HYDROTREATING AND CATALYST CASCADING

BACKGROUND OF THE INVENTION

1. Field of the Invention

This invention relates to coal liquefaction and is particularly related to staged catalytic coal hydrogenation and liquefaction process for producing high quality, low boiling hydrocarbon liquid products.

2. Description of Prior Art

The two primary approaches for converting coal to liquid fuels are called direct and indirect coal liquefaction. Direct coal liquefaction ("DCL") reacts coal in a solvent with hydrogen at high temperatures and pressure to produce liquid fuels. DCL was first developed by Dr. Bergius in Germany in 1913 and used commercially in Germany between 1927 and 1945. However, after World War II, crude oil was widely available at reasonable prices and commercial coal liquefaction was therefore not commercially attractive. As a result, very little liquid fuels sold today are produced using a coal liquefaction process.

Indirect coal liquefaction ("ICL") involves first gasifying coal to produce a synthesis gas which contains principally carbon monoxide and hydrogen and thereafter processing the gas chemically into a variety of fuels.

Where diesel and gasoline type feeds are desired utilizing ICL, the Fischer-Tropsch process is preferably used. The ICL technology was been commercially applied in the 1920-1940's in Germany and since the 1950's in South Africa. While commercially demonstrated, the ICL technologies are very complex, capital intensive, and have low thermal efficiencies.

In the 1970's and 1980's extensive research and development were conducted for direct coal liquefaction in the United States and world-wide, as oil shortages and high oil prices were experienced. The objectives were to produce transportation fuels from coal to reduce oil imports. The US Department of Energy provided financial and technical support to demonstrate two technologies on a large scale (200 ton/day coal feed). The Exxon Donor Solvent ("EDS") technology liquefies coal with hydrogen and a hydrogen donor solvent at temperatures of 800-840° F. (427-449° C.) and pressures of 2500-3000 psia (172-207 bars). Process derived distillate coal liquids boiling at 400-700° F. (204-371° C.) are hydrotreated at mild conditions over a fixed bed of hydrotreating catalyst (typically nickel-molybdenum on alumina) and recycled as coal slurry oil. From an Illinois No. 6 coal, liquid yields of over 40 w % on dry ash free ("DAF") coal were obtained during the 2-year demonstration program.

Additionally, the H-Coal Process was invented by Hydrocarbon Research, Inc. and is generally described in U.S. Pat. Nos. 3,519,553 and 3,791,959. The H-Coal Process uses a single ebullated bed reactor with a hydroconversion catalyst to convert coal to liquid fuels. Product oil (400° F.+, i.e. 204° C.+)) was used to slurry the coal for feeding to the reactor. Coal liquefaction took place at temperatures of 800-875° F. (427-468° C.), and hydrogen partial pressures of 1500-2500 psia (103-172 bars). With Illinois No. 6 coal, liquid yields of greater than 50 w % on DAF coal were achieved during the multi-year year demonstration program at the 200 ton per day H-Coal Pilot Plant in Catlettsburg, Ky. The DCL technologies demonstrated commercial readiness, however, no commercial projects proceeded as oil prices fell and oil supplies increased.

In the 1980's and 1990's research continued at a smaller scale to improve the DCL technologies and reduce investments and operating costs. The Catalytic Two-Stage Liquefaction Process (CTSL) was invented by Hydrocarbon Research, Inc., as described in U.S. Pat. Nos. 4,842,719, 4,874,506, and 4,879,021, to substantially increase the yield of distillate liquids from coal. For Illinois No. 6 bituminous coal, liquid yields were increased from 3 barrels per ton of MAF coal for the single stage H-Coal Process to about 5 barrels per ton of MAF coal for the CTSL Process. This was achieved by dissolving the coal feed at mild conditions while simultaneously hydrogenating the coal recycle solvent and coal liquids produced at temperatures from 600-800° F. (316-427° C.), hydrogen partial pressures of 1500-2500 psia (103-172 bars) in the presence of a hydrogenation catalyst.

The coal is then fed to a direct-coupled second stage reactor operating at higher temperatures of approximately 800-850° F. (427-454° C.) and at similar pressures (1500-2500 psia, i.e. 103-172 bars) with a hydroconversion catalyst, to achieve maximum coal conversion and high distillate liquid yields. The hydrogenation catalyst used for the single-stage and two-stage processes deactivates at these reactor conditions due to the deposition of coke and also soluble metals from the coal feed if present. The catalyst is expensive and its replacement in the ebullated-bed reactors therefore greatly contributes to the high cost of coal liquids produced.

Recognizing this problem, U.S. Pat. No. 3,679,573 (Johnson), disclosed a catalytic two-stage coal liquefaction process in which used catalyst is removed from the second-stage reactor and thereafter recycled to the first stage reactor at approximately the same reactor conditions. This so-called catalyst cascading from the second reactor to the first reactor runs counter to the current of the coal feed direction and reduces the quantity of catalyst addition required to achieve a constant liquid product yield and quality.

Unexpectedly and contrary to the prior art, it was learned that the where the first stage reactor was maintained at least 25° F. lower than the second stage reactor in the CTSL process, the coke deposited on the first stage catalyst is substantially lower than on the second stage catalyst. Moreover, the first stage catalyst activity was substantially higher than the second stage catalyst.

U.S. Pat. No. 4,816,141, McLean et al, teaches that the co-current cascading of hydrogenation catalyst from the first stage reactor to the second stage reactor substantially decreases overall catalyst requirements and reduces the cost of producing liquid fuel from coal.

As international fuel quality specifications have become more stringent, there became a growing need for coal liquids having extremely low levels of contaminants (sulfur, nitrogen), low aromatics content, and high cetane indexes. Progress toward this goal has been made by further hydrotreating and hydrocracking the coal liquids in separate downstream processes with new catalysts to meet the desired product quality.

We now have an improved process for integrating the liquid product hydrotreating stage with the catalytic two stage coal liquefaction process, utilizing a single hydroconversion catalyst cascading from the liquid product hydrotreating stage to the first stage low temperature reactor to the higher temperature second stage reactor. Liquid product qualities are greatly improved to meet current or projected industry specifications without any increase in catalyst addition rates on a coal feed basis. Further, the used catalyst from the process can be regenerated by carbon removal and reused in the process in a similar manner as the fresh makeup catalyst described in this invention disclosure.

SUMMARY OF THE INVENTION

The invention concerns an integrated multi-stage liquefaction and hydrotreatment process for directly converting coal or similar liquefiable carbonaceous solids into lower molecular weight liquid hydrocarbons which comprises feeding carbonaceous material and recycled slurry under liquefaction conditions in a plurality of liquefaction reactors to create a coal liquids effluent, and subsequently hydrotreating said coal liquids effluent in a hydrotreatment reactor wherein (1) said liquefaction reactors and said hydrotreatment reactors are arranged is series; and (2) a portion of the catalyst utilized in said hydrotreatment reactor is removed and utilized in the first liquefaction reactor; and (3) a portion of the catalyst from said first liquefaction reactor is thereafter cascaded and utilized in to the next liquefaction reactor in the series. Generally, there are 2 liquefaction reactors and one (or more) hydrotreatment reactor. Here after there are called Stage 1 for the 1$^{st}$ stage liquefaction reactor, Stage 2 for the second stage liquefaction reactor and Stage 3 for the hydrotreatment reactor(s).

Each liquefaction or hydrotreatment contains a particulate catalyst containing at least one metal selected from the group consisting of Co, Fe, Mo, Ni, Sn, W. Preferably the catalyst contains at least one GVIII metal and at least one GVI metal, preferably selected among Co, Ni, Mo, W. More preferably there are NiMo, CoMo, or NiW. Metals are deposited on a support selected from the group consisting of alumina, magnesia, silica, titania, and similar materials. Useful catalyst particle sizes can range from about 0.02 to 0.20 inch effective diameter and can be any shape including spherical beads or extrudates. Catalysts are sulfurised to form a sulfurised active phase. Preferably the same catalyst is used in liquefaction reactors and hydrotreatment reactor(s).

A slurry catalyst such as iron pyrites may be added with the coal slurry feed to improve coal conversion.

The coal feed for this process may be bituminous coal such as Illinois No. 6 or Kentucky No. 11; sub-bituminous coal such as Wyodak, or lignite.

The term "coal" used in the text may also include liquefiable carboneous solids having properties similar to coal. Generally, coal is ground to a desired particule size range of usually 50-375 mesh (US Sieve series) and dried to a desired moisture content of usually 2-10 wt % moisture.

The coal is usually mixed with a coal-derived slurrying oil from the process (as recycle) and having a normal boiling range of 500° F. (260° C.) and higher, with at least about 50% of the slurrying oil preferably having a normal boiling temperature above about 700° F. (371° C.).

Also, suitable slurrying oil for the coal may be selected from the group consisting of petroleum derived residual oil, shale oil, tar sand bitumen, and oil derived from coal from another process including coal pyrolysis or mild gasification which produces coal liquids. So, a portion of the coal slurry oil is an external liquid hydrocarbon such as petroleum residue or coal pyrolysis oil.

A sulfur or sulfur compound may be added to the coal slurry feed to improve coal conversion.

This coal-oil slurry is fed into the lower temperature first stage catalytic reaction zone which is maintained at selected moderate temperature under hydrogen pressure conditions and in the presence of a particulate hydrogenation catalyst which promotes controlled rate of hydrogenation and liquefaction of the coal, while simultaneously hydrogenating the solvent oil at conditions which favor such hydrogenation reactions usually less than about 800° F. (427° C.).

Liquefaction reactors are maintained at temperatures ranging of 700°-860° F. (371-460° C.), 1000-4000 psia (69-276 bars) hydrogen partial pressure, and an space velocity of 10-90 lb coal/hr per ft$^3$ catalyst settled volume; said hydrotreatment reactor is operated a temperature of between 650°-750° F. (343-399° C.), 1000-4000 psia (69-276 bars) hydrogen partial pressure, and an oil space velocity of 20-180 lb oil/hr per ft$^3$ catalyst settled volume in the reactor.

The first stage reaction zone is a reactor which contains an ebullated-bed of particulate hydrotreating catalyst to hydrogenate the particulate feed coal, solvent oil and dissolved coal molecules and produce desired low-boiling hydrocarbon liquid and gaseous materials. The first stage reaction zone is preferably maintained at conditions of 7000-800° F. (371-427° C.) temperature, 1000-4000 psia (69-276 bars) hydrogen partial pressure, and a coal feed rate or space velocity of 10-90 lb coal/hr per ft$^3$ catalyst settled volume to liquefy the coal and produce a high quality hydrocarbon solvent material, while achieving greater than about 70 W % conversion of the coal to tetrahydrofuran (THF) soluble materials.

At such mild reaction conditions, hydrocracking, condensation and polymerization reactions, as well as formation of undesired hydrocarbon gases, are all advantageously minimized. Moreover, the mild reaction conditions are used to permit the catalytic hydrogenation reactions to keep pace with the rate of coal conversion. Preferred first stage reaction conditions for an Illinois No. 6 bituminous coal are 720°-780° F. (382-416° C.) temperature; 1500-3500 psia (103-241 bars) hydrogen partial pressure and coal space velocity of 20-70 lbs coal/hr per ft$^3$ catalyst settled volume. Of course, the preferred conditions vary and are specific to the type of coal being processed.

From the first stage reaction zone, the total effluent material is passed with additional hydrogen to the second stage catalytic reaction zone, where the material is further hydrogenated and hydrocracked at a temperature at least about 25° F. (14° C.) higher than for the first stage reaction zone. Both stage reaction zones are upflow, ebullated-bed catalytic reactors, with the second stage reaction zone being preferably close-coupled to the first stage reaction zone; however, gaseous material can be withdrawn interstage if desired. For the second stage reactor, the reaction conditions are maintained at higher severity which promotes more complete thermal conversion of the coal to liquids, hydroconversion of primary liquids to distillate products, and product quality improvement via heteroatoms removal at temperature greater than 800° F. (427° C.), and hydrogen partial pressure similar to the first stage reaction zone.

The desired second stage reaction conditions are 750-860° F. (399-460° C.) temperature, 1000-4000 psia (69-276 bars) hydrogen partial pressure and coal space velocity of 10-90 lb coal/hr ft$^3$ catalyst settled volume to achieve at least about 90 W % overall conversion of the original feed coal. The asphaltene and pre-asphaltene compounds produced from the coal are also converted to lower boiling hydrocarbon materials and the heteroatoms (nitrogen, sulfur, and oxygen) from the coal and coal liquids are further reduced to provide distillate liquid products.

The reactor space velocity is adjusted to achieve the desired product slate. Preferred second stage reaction conditions are 780-850° F. (404-454° C.) temperature, 1500-3500 psia (103-241 bars) hydrogen partial pressure and coal space velocity of 20-70 lb coal/hr per ft$^3$ catalyst settled volume.

The second stage reactor effluent contains a mixture of coal solids, coal derived liquids, and hydrogen rich vapors. The effluent is separated by conventional vapor/slurry separation and the light liquid hydrocarbons and hydrogen containing vapor are recovered and fed to a third reaction stage for improving the liquid product quality. This hydrotreating reactor can be either a fixed-bed or an ebullated-bed type. The coal liquids and hydrogen containing stream is passed over a hydrotreating catalyst at reaction conditions are 650-750° F. (343-399° C.) temperature, 1000-4000 psia (69-276 bars) hydrogen partial pressure and an oil space velocity of 20-180 lb oil/hr per $ft^3$ catalyst settled volume to achieve a $C_4$ to 700° F. (371° C.) coal liquid product containing less than 200 wppm nitrogen and less than 100 wppm sulfur, or preferrably less than 10 wppm of nitrogen and sulfur.

The catalyst activity is maintained by withdrawing a portion of the aged catalyst and replacing it with an equivalent quantity of fresh catalyst on a periodic basis, typically daily to weekly. The catalyst replacement rate is similar or the same as required to maintain the activity in the Stage 1 and Stage 2 coal liquefaction reactors.

This multi-stage catalytic coal liquefaction process provides high selectivity to low boiling hydrocarbon liquid products, high quality coal liquid products, and desired low yields of $C_1$-$C_3$ hydrocarbon gases and residuum materials, together with minimal deactivation of the catalyst, which provides for extended activity and useful life of the catalyst.

The present multi-staged coal liquefaction process advantageously provides a significant improvement over prior two-stage coal liquefaction processes, by providing for coal liquid product quality improvement and forward cascading of used catalyst from the lower temperature coal liquid hydrotreating stage to the first coal liquefaction reaction stage and then to the next succeeding higher temperature reaction zone. The reaction conditions are selected to provide controlled hydrogenation and conversion of the coal to mainly low-boiling liquid products, while simultaneously hydrogenating the recycle and coal-derived product oils.

Because the coal feed is dissolved in a high quality hydrocarbon solvent in the lower temperature first stage reactor, the potential for retrogressive (coke forming) reactions is significantly reduced and solvent quality, hydrogen utilization and heteroatom removal are appreciably improved, which increases potential conversion of the coal while also extending the catalyst effective life.

Thus the present invention provides a staged catalytic coal hydrogenation and liquefaction process for producing high quality, low boiling hydrocarbon liquid products, in which the liquid products are hydrotreated at a low temperature of less than 800° F. (427° C.) with a hydrogenation catalyst in the presence of hydrogen.

According to the invention, fresh hydrogenation catalyst is added to a hydrotreating reactor (Stage 3) to maintain activity for hydrotreating to reduce the coal liquid heteroatom contaminants in the coal liquids formed in the coal liquefaction process, to stabilize the coal liquids, and to increase the hydrogen content. The catalyst performs the coal liquid product hydrotreating and a portion of the aged catalyst in this Stage 3 reactor is removed, transported, and added to the Stage 1 coal liquefaction reactor.

The aged catalyst withdrawn from the low temperature Stage 3 reactor should have an average age of 500-5000 lb. oil processed/lb catalyst. This transported catalyst has low coke content and high activity and can be reused in the liquefaction process. Fresh coal feed and recycle coal slurry oil are fed to a first stage (Stage 1) coal liquefaction reactor with hydrogen. The Stage 1 coal liquefaction reactor is operated at a temperature of less than about 800° F. (427° C.). The objective this first stage is to mildly hydrogenate the coal solvent oil and the coal liquids produced at these mild conditions as well as produce some moderate coal conversion.

For an Illinois bituminous coal, the Stage 1 coal conversions have been found to be in the range of 50 to 90 w % MAF coal. For a Wyoming sub-bituminous coal, the coal conversions are lower, ranging between 40 to 85% on MAF coal. Again, the catalyst performs the hydrogenation function in Stage 1 and a portion of the aged catalyst in this Stage 1 reactor is removed and thereafter cascaded forward to a higher temperature (Stage 2) downstream ebullated-bed reactor for further use therein, and to achieve high conversion of the coal and longer useful life for the catalyst.

Overall coal conversion of the close-coupled two stage coal liquefaction reactors have been in the range of 94 to 97% for the Illinois bituminous coal and 90 to 95% for the Wyoming sub-bituminous coal. The reactors are designated by the coal flow sequence through the process flowing from Stage 1 to Stage 2. A particulate coal such as bituminous or sub-bituminous coal and a heavy hydrocarbon solvent material normally boiling above about 500° F. (260° C.) are first mixed together to provide a solvent/coal weight ratio of between about 1.0 and 3.0. The resulting coal-oil slurry is catalytically hydrogenated and liquefied using two ebullated-bed catalytic reactors connected in a series arrangement.

The first stage reactor preferably operates at a lower temperature Of 7000 to 800° F. (371-427° C.) temperature, and the second stage reactor higher-temperature is 7500 to 870° F. (399-466° C.) and at least about 25° F. (14° C.) higher than the first stage reactor temperature. Useful space velocity is 10-90 lb coal/hr per $ft^3$ catalyst settled volume in the reactors.

It has been found that less catalyst deactivation occur in the lower temperature first stage coal liquefaction reactor than in the higher temperature second stage reactor, apparently because of the lower operating temperatures and the better hydrogenation environment in the first stage reactor. The catalyst activity in each reactor is controlled by withdrawing aged catalyst and replacing it with fresh or lower aged catalyst. In this example the catalyst from the lower temperature first stage reactor is cascaded to the stage 2 reactor having higher thermal severity, so that effective use can be made of catalytic activity remaining in the aged catalyst removed from the lower temperature reactor.

The aged catalyst withdrawn from the lower temperature or first stage reactor should have an average age of 300-3000 lb coal processed/lb catalyst. Also, the aged catalyst withdrawn from the higher temperature or second stage reactor should have an average catalyst age of at least 600 lb coal processed/lb catalyst and preferably 600-6000 lb/lb which includes the coal processed in both the first and second stages. By use of this invention, significantly more feed coal can be advantageously hydrogenated and liquefied per pound of fresh catalyst used, or alternatively significantly less fresh catalyst is required per ton of coal processed to produce desired low boiling hydrocarbon liquid products. Further, the coal liquids produced are of high hydrogen content, are stable, and contain less than 200 wppm nitrogen and less than 100 wppm sulfur.

The present process is advantageously improved over other two-stage coal liquefaction processes and achieves high yields of hydrocarbon distillate, lower molecular weight liquid products, improved liquid product quality and lower fresh catalyst usage than for other catalytic coal hydrogenation and liquefaction processes. Also, the used cascaded catalyst withdrawn from the higher temperature second stage reactor has less carbon deposits than used originally fresh catalyst from the second stage reactor, and has a lower deactivation rate than the originally fresh catalyst. The net products from the process are controlled to yield C1-C3 gases, C4—750° F. (C4—399° C.) distillate, and a solids stream containing principally unconvertible mineral matter or ash. Also, the preferred recycle of heavy 600° F.+ (316° C.) hydrocarbon liquid materials to the first stage reactor reduces or eliminates any net production of undesirable heavy oils.

The invention increases the overall effective age of used catalyst by up to about 100%, so that the fresh catalyst required per ton of coal processed to produce desired low-boiling hydrocarbon liquid products is reduced by up to about 50%, thereby saving costs. Further, the used catalyst from the second stage reactor can be recovered and regenerated and reused in the process. This substantially reduces the quantity of fresh catalyst makeup and the quantity of waste catalyst to be disposed of.

More specifically, the invention relates to an integrated multi-stage liquefaction and hydrotreatment process for directly converting coal into lower molecular weight liquid hydrocarbons which comprises feeding coal and recycled slurry under liquefaction conditions in a plurality of liquefaction reactors to produce a coal liquid effluent, and subsequently hydrotreating said coal liquid effluent in a hydrotreatment reactor wherein: 1) said liquefaction reactors and said hydrotreatment reactor are arranged is series; 2) a portion of the catalyst utilized in said hydrotreatment reactor is removed and utilized in the first liquefaction reactor; and 3) a portion of the catalyst from said first liquefaction reactor is thereafter cascaded and utilized in to the next liquefaction reactor in the series.

BRIEF DESCRIPTION OF THE DRAWINGS

FIG. 1 is a schematic flow diagram of a catalytic two-stage coal hydrogenation and liquefaction process integrating coal liquid product hydrotreating and utilizing cascaded catalyst in all three stages in accordance with the invention.

DETAILED DESCRIPTION OF THE INVENTION

In the present invention, improved hydrogenation and liquefaction of coal is achieved by a two-stage catalytic process using two well-mixed ebullated-bed catalytic reactors which are preferably direct-connected in series arrangement. As is shown in FIG. 1, a coal such as Illinois No. 6 bituminous or Wyoming sub-bituminous type is provided at 10 and passed through a coal preparation unit 12, where the coal is ground to a desired particle size range of usually 50-375 mesh (U.S. Sieve Series) and dried to a desired moisture content of usually 2-10 W % moisture.

The particulate coal is then slurried at slurry tank 14 with sufficient process-derived recycle solvent liquid 15 having a normal boiling temperature above about 500° F. (260° C.) to provide a flowable slurry. The weight ratio of solvent oil/coal is usually in a range of 1.0-4.0, with 1.1-3.0 ratio usually being preferred. The coal/oil slurry is pressurized at pump 16, mixed with recycled hydrogen at 17, preheated at heater 18 to 550°-700° F. (288-371° C.) temperature and is then fed to the inlet of first stage catalytic ebullated-bed reactor 20. A separate hydrogen heater at 18*a* can be provided if required for heat balance. Fresh make-up high-purity hydrogen is provided at 17*a* as needed.

The coal/oil slurry and hydrogen streams enter reactor 20 containing an ebullated catalyst bed 22, passing uniformly upwardly through flow distributor 21 at a flow rate and temperature and pressure conditions to accomplish the desired hydrogenation reactions therein. The operation of the ebullated-bed catalytic reactor including recycle of reactor slurry upward through the expanded catalyst bed is generally well known and is described by U.S. Pat. No. 4,437,973, which is incorporated herein by reference.

The first stage reactor 20 contains a particulate hydrotreating as known in the art. It contains usually at least one GVIII metal and at least one GVI metal and is sulfurized before use. Preferably it contains at least one metal selected from the group consisting of Co, Fe, Mo, Ni, Sn, W. More preferably metals are CoMo, NiMo, or NiW. The support may be alumine and/or silice. The catalyst activity is maintained by withdrawing a portion of the aged catalyst and replacing it with an equivalent quantity of fresh catalyst on a periodic basis, typically daily to weekly. To reduce fresh catalyst makeup, partially aged particulate-hydrogenation catalyst from reactor 60 may be added to reactor 20 at connection 23 in the ratio of about 0.1 to 2.0 pounds of catalyst per ton of coal processed.

The upper level of ebullated-bed 22 is monitored by nuclear device 22*a* for detecting the catalyst level therein. Spent catalyst may be removed from reactor 20 at connection 24 to maintain the desired catalytic activity within the reactor 20, and transferred to the second stage reactor 30 as described further herein below.

Operating conditions in the first stage reactor 20 are maintained at moderate temperature range of 700°-800° F. (371-427° C.), 1000-4000 psia (69-276 bars) hydrogen partial pressure, and coal feed rate or space velocity of 10-90 lb coal/hr per $ft^3$ catalyst settled volume in the reactor. The preferred reaction conditions are 720°-780° F. (382-416° C.) temperature, 1500-3500 psia (103-241 bars) hydrogen partial pressure and feed rate of 20-70 lb coal/hr per $ft^3$ catalyst settled volume in the reactor and will be specific to the particular coal being processed, because different coals convert to liquids at different rates. The optimal first stage reaction conditions will allow maximum utilization of hydrogen shuttling solvent compounds, such as pyrene/hydropyrenes known to be present in coal-derived recycled oils, since catalytic rehydrogenation of donor species occurs simultaneously with solvent-to-coal hydrogen transfer.

Coal-derived oils are also exposed to an efficient catalytic hydrogenation atmosphere immediately upon their formation, thereby reducing the tendency for regressive repolymerization reactions which lead to poor quality hydrocarbon liquid products. First stage reactor thermal severity is quite important, as too high a severity leads to a coal conversion rate which is too rapid for the catalytic hydrogenation reactions to keep pace. Moreover, the higher severity environment results in poor hydrogenation equilibrium for the solvent compounds. Additionally, a low thermal severity in the first stage, while still providing an efficient atmosphere for solvent hydrogenation, does not yield sufficient coal conversion to provide a significant process improvement.

In the first stage reactor, the objective is to hydrogenate the aromatic rings in molecules of the feed coal, recycle solvent and dissolved coal so as to produce a high quality hydrogen donor solvent liquid in the presence of hydrogen and the hydrogenation catalyst. At the moderate catalytic reaction conditions used, hetero atoms such as sulfur, nitrogen, and oxygen are removed, retrogressive or coke forming reactions are essentially eliminated, and hydrocarbon gas formations are effectively minimized. Because of the reaction conditions used, i.e., relatively low temperature first stage, the catalyst promotes coal hydrogenation and minimizes polymerization and cracking reactions. Also because of these improved conditions in the first stage reactor, less coke is deposited on the catalyst at the milder and favorable hydrogenation reaction conditions used, and the deposited coke also has a desirably higher hydrogen/carbon ratio than for prior coal liquefaction processes, which minimizes catalyst deactivation and appreciably prolongs the effective life of the catalyst.

From the first stage reactor 20, the total effluent material at 26 is mixed with additional hydrogen 28 (preferably) preheated and flows through conduit 29 directly to the inlet of the close-coupled second stage catalytic reactor 30. The term close-coupled reactors used herein means that the volume of connecting conduit 29 extending between the first and second stage reactors is limited to only about 2-8% of the volume of the first reactor, and is preferably only 2.4-6% of the first reactor volume. Reactor 30 operates similarly to reactor 20 and contains a flow distributor grid 31 and catalyst ebullated bed 32, and is operated at a temperature at least about 25° F. (14° C.) higher than that for the first stage reactor, and usually in the temperature range of 750-860° F. (399-460° C.). The higher temperature used in reactor 30 may be accomplished by utilization of the preheated hydrogen stream 28 as well as the heat of reaction from the second stage reactor.

The second stage reactor pressure is sufficiently lower than for the first stage reactor, this permits forward flow of the first stage material without any need for pumping, and additional make-up hydrogen is added at 28 to the second stage reactor as needed. As mentioned above, the particulate catalyst used in the first stage reactor is cascaded and re-utilized in the second stage reactor ebullated-bed 32. The upper level of ebullated-bed 32 is monitored by a nuclear device 32*a* for detecting the catalyst level therein.

Make-up catalyst is supplied to ebullated-bed 32 of reactor 30 from used catalyst withdrawn at 24 from first stage reactor catalyst bed 22. This first stage used catalyst can be withdrawn at connection 24 periodically and added to reactor 30 at connection 33 or it can be transferred forward through conduit 25 shown in dotted lines in FIG. 1. The used catalyst withdrawn from first stage reactor bed 22 should have an average catalyst age of 500-2000 Lb coal processed/Lb catalyst.

Also, an average contaminant level or a catalyst activity test can be used to ascertain when to cascade forward the used catalyst and at what rate. Because the total pressure of the second stage reactor 30 will be at least about 25-100 psi lower than the pressure of first stage reactor 20, a catalyst-oil slurry from bed 22 can be transferred to reactor bed 32 without difficulty. The used catalyst from ebullated-bed 32 is withdrawn at connection 34, and may be discarded or regenerated for further use in the process.

In the second stage reactor 30, the reaction conditions are selected to provide a more complete catalytic conversion of the unconverted coal to liquids, utilizing the high quality solvent liquid produced in the first stage reactor. The remaining reactive coal as well as preasphaltenes and asphaltenes are converted to distillate liquid products and additional heteroatoms (nitrogen, sulfur, and oxygen) are removed.

Substantial secondary conversion of coal derived liquids to distillate products is also accomplished in the second stage reactor. The reaction conditions are selected to minimize gas formation or dehydrogenation of the first stage liquid effluent materials. Useful reactor conditions are 750 to 860° F. (399-460° C.) temperature, 1000-4000 psia (69-276 bars) hydrogen partial pressure, and coal space velocity of 10-90 lb coal/hr per $ft^3$ catalyst settled volume. Preferred reaction conditions will depend on the particular type of coal being processed, and are usually 760°-850° F. (404-454° C.) temperature, 1500-3500 psia (103-241 bars) hydrogen partial pressure, and space velocity of 20-70 lb coal/hr per $ft^3$ catalyst settled volume. Preferably, the catalyst used is the same as described for the first stage reactor 20.

From the second stage reactor 30, the effluent material at 38 is passed to a phase separator 40 operating at near reactor conditions, wherein a vapor fraction 41 is separated from a solids-containing liquid slurry fraction at 44. The vapor fraction 41 is cooled and passes to the third-stage hydrotreating reactor 60.

The slurry liquid 44 is pressure-reduced at 47 to near atmospheric pressure, and passed to an atmospheric distillation system, generally shown at 50. The distillate liquid fractions are recovered by a vapor/liquid flash in the atmospheric distillation system 50 to produce distillate liquid product stream 52. A light vapor stream 51 is recovered and sent to the downstream gas recovery section. The recovered distillate liquid stream 52 is fed to pump 53 and pressurized and blended with vapor stream 41 and transferred to the third stage hydrotreating reactor 60. A bottoms stream 54 is passed to an effective liquid-solids separation step 55, from which unconverted coal and ash solids material is removed at 56. The remaining liquid stream 57 having a solids concentration less than about 30 W % solids and preferably 0-20 W % solids is recycled by pump 58 as the slurry oil 15 to slurry tank 14.

The unconverted coal and ash solids are preferably substantially or completely removed to provide for recycle of a 600° F.+ (316° C.+) heavy hydrocarbon stream to the coal slurrying step, so as to achieve substantially high conversion of all the 600° F.+ (316° C.+) oils to light distillate products and avoid production of heavy oils which are generally considered undesirable. The recycle oil preparation in liquid-solids separation step 55 can be improved by reducing its solids concentration (ash and unconverted coal) to less than about 20 W % and preferably 0-15 w % by using known solids removal means in separation step 55, such as by use of vacuum fractionation, centrifuges, filtration, extraction or solvent deashing techniques known in the industry. This slurrying liquid at 57 is recycled as stream 15 back to the mixing step at slurry tank 14, where it is mixed with the coal feed to the first stage reactor 20 to provide an oil/coal weight ratio of 1.0-4.0, and preferably 1.1-3.0 ratio. If desired, a reduced solids concentration product stream can be withdrawn at 59.

The recovered distillate coal liquids 52 mixed with the vapor fraction 41 which contains hydrogen and light hydrocarbon liquids enter the hydrotreating reactor 60 containing an ebullated catalyst bed 62, passing uniformly upwardly through flow distributor 61 at a flow rate and at temperature and pressure conditions to accomplish the desired hydrogenation reactions therein. The operation of the ebullated-bed catalytic reactor including recycle of reactor product oil upward through the expanded catalyst bed is generally well known and is described by U.S. Pat. No. 4,437,973, which is incorporated herein by reference to the extent needed.

The hydrotreating stage reactor 60 contains a particulate hydrotreating catalyst as defined previously for 1st and $2^{nd}$ stage reactor. Preferably, the catalyst for hydrotreating stage is identical to the catalyst for 1st and $2^{nd}$ liquefaction stage. Fresh particulate hydrogenation catalyst may be added to reactor 60 at connection 63. The quantity of catalyst added is as required to maintain catalyst activity in the Coal Liquefaction reactors 20 and 30. The catalyst addition rate is in the range of about 0.1 to 2.0 pounds of catalyst per ton of coal feed to reactor 20. The upper level of ebullated-bed 62 is monitored by nuclear device 62*a* for detecting the catalyst level therein. Spent catalyst may be removed from reactor 60 at connection 64 to maintain the desired catalytic activity within the reactor 20 and 30, and transferred to the first stage coal liquefaction reactor 20 as described above. This hydrotreating reactor 60 may alternatively be a fixed-bed catalytic reactor designed to allow easy catalyst removal and cascading.

Operating conditions in the hydrotreating reactor 60 are maintained at a low temperature range of 650°-750° F. (343-399° C.), 1000-4000 psia (69-276 bars) hydrogen partial pressure, and an oil space velocity of 20-180 lb oil/hr per $ft^3$ catalyst settled volume in the reactor. The preferred reaction conditions are 670-730° F. (354-388° C.) temperature, 1500-3500 psia (103-241 bars) hydrogen partial pressure and feed rate of 30-100 lb oil/hr per ft3 catalyst settled volume in the reactor. These operating conditions and the presence of fresh hydrogenation catalyst are sufficient to provide reduction of the coal liquid heteroatoms to less than 200 wppm nitrogen and 100 wppm sulfur, or lower to meet the required product stability and quality specifications.

The hydrotreating reactor can operate at similar pressure as the coal liquefaction reactors 20 and 30 or at reduced pressure to reduce reactor investment. The hydrotreating reactor effluent material at 68 is passed to a phase separator 70 operating at near the hydrotreating reactor conditions, wherein a vapor fraction 71 is separated from a liquid fraction at 74. The vapor fraction 71 is cooled and treated at the hydrogen purification unit 72 from which hydrogen rich stream 75 is withdrawn and recycled to the hydrogen compressor 19 and passes to the reactors 20 and 30 with the high purity makeup hydrogen 17*a*.

A low hydrogen-purity purge stream 76 is purged from the system for further hydrogen recovery or for use as plant fuel gas. The hydrotreated liquid product at 74 is reduced in pressure and fed to atmospheric fractionator 80 to recover the desired liquid product at 82. The vent gas at 81 containing light hydrocarbon gases is used for fuel gas or as feedstock for hydrogen production. The coal liquids product at 82 is of high quality and stable and can either be used directly as transportation and heating fuels or further upgraded to produce gasoline and diesel fuels.

The invention described herein has been disclosed in terms of specific embodiments and applications. However, these details are not meant to be limiting and other embodiments, in light of this teaching, would be obvious to persons skilled in the art. Accordingly, it is to be understood that the drawings and descriptions are illustrative of the principles of the invention, and should not be construed to limit the scope thereof.

We claim:

1. An integrated multi-stage liquefaction and hydrotreatment process for directly converting coal into lower molecular weight liquid hydrocarbons which comprises feeding coal and recycled slurry under liquefaction conditions in a plurality of liquefaction reactors to produce a coal liquid effluent, and subsequently hydrotreating said coal liquid effluent in a hydrotreatment reactor wherein: 1) said liquefaction reactors and said hydrotreatment reactor are arranged in series with a separator unit in between said liquefaction reactors and said hydrotreatment reactor to separate said coal liquid effluent into a vapor fraction boiling below 1000° F. and a residue fraction containing the heavier components including ash and unconverted coal and wherein only said vapor fraction is thereafter fed to said hydrotreatment reactor; 2) fresh catalyst is first added to said hydrotreatment reactor and is thereafter removed and cascaded to the first liquefaction reactor; and 3) a portion of said catalyst from the first liquefaction reactor is thereafter cascaded and utilized in the next liquefaction reactor in the series; and wherein the temperature of said hydrotreatment reactor is lower than the operating temperature of said first liquefaction reactor and the temerature of said first liquefaction reactor is lower than the next liquefaction reactor in the series.

2. The process of claim 1 wherein there are two liquefaction reactors.

3. The process of claim 1 wherein the catalyst is a particulate catalyst containing at least one metal from the group consisting of cobalt, iron, molybdenum, nickel, tin, tungsten.

4. The process of claim 1 wherein a slurry catalyst such as iron pyrite is added with the coal and recycled slurry.

5. The process of claim 1 wherein sulfur or a sulfur compound are added to the coal and recycled slurry feed.

6. The process of claim 1 in which a portion of the coal slurry oil is an external liquid hydrocarbon such as petroleum residue or coal pyrolysis oil.

7. The process of claim 1 wherein said liquefaction reactors are maintained at temperatures ranging of 700° -860° F. (371-460° C.) , 1000-4000 psia (69-276 bars) hydrogen partial pressure, and an space velocity of 10-90 lb coal/hr per $ft^3$ catalyst settled volume; said hydrotreatment reactor is operated a temperature of between 650° -750° F.,(343-399° C.) 1000-4000 psia (69-276 bars) hydrogen partial pressure, and an oil space velocity of 20-180 lb oil/hr per $ft^3$ catalyst settled volume in the reactor.

* * * * *